US009559469B2

(12) United States Patent
Nishimori et al.

(10) Patent No.: US 9,559,469 B2
(45) Date of Patent: Jan. 31, 2017

(54) CONNECTOR

(71) Applicant: JAPAN AVIATION ELECTRONICS INDUSTRY, LIMITED, Tokyo (JP)

(72) Inventors: Hiroto Nishimori, Tokyo (JP); Minoru Shinmyo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/091,785

(22) Filed: Apr. 6, 2016

(65) Prior Publication Data

US 2016/0315425 A1 Oct. 27, 2016

(30) Foreign Application Priority Data

Apr. 21, 2015 (JP) ..... 2015-086740

(51) Int. Cl.
*H01R 13/6597* (2011.01)
*H01R 13/40* (2006.01)
*H01R 13/6594* (2011.01)

(52) U.S. Cl.
CPC ..... *H01R 13/6597* (2013.01); *H01R 13/40* (2013.01); *H01R 13/6594* (2013.01)

(58) Field of Classification Search
CPC ..... H01R 9/037; H01R 13/40; H01R 13/652; H01R 13/65802; H01R 13/6591; H01R 13/6594; H01R 13/6597; H01R 23/02; H01R 23/6873; H01R 23/7073
USPC ..... 439/607.34, 95, 96, 607.35, 607.4, 660
See application file for complete search history.

(56) References Cited

U.S. PATENT DOCUMENTS 5,447,311 A 9/1995 Viollaz et al.
6,074,223 A * 6/2000 Huang ..... G06K 19/07735 361/799
6,089,882 A * 7/2000 Costello ..... H01R 13/65802 439/95
6,099,327 A * 8/2000 Chen ..... H01R 13/65802 439/607.28
6,482,037 B1 * 11/2002 Zhu ..... H01R 23/6873 439/108
6,619,985 B1 * 9/2003 Ko ..... H01R 12/775 439/579

(Continued)

FOREIGN PATENT DOCUMENTS

EP 2 827 459 A1 1/2015
JP 2006-310164 A 11/2006

OTHER PUBLICATIONS

Extended European Search Report in Ep 16165423.1, dated Sep. 13, 2016.

*Primary Examiner* — Tulsidas C Patel
*Assistant Examiner* — Travis Chambers
(74) *Attorney, Agent, or Firm* — Collard & Roe, P.C.

(57) ABSTRACT

Provided is a connector whose miniaturization is easier than before. A connector includes a signal terminal as at least one first terminal having conductivity, a housing having insulating property and holding the signal terminal, a shell having conductivity and covering the housing, and an upper ground terminal as a second terminal having conductivity and a lower ground terminal as a third terminal having conductivity which are held by the housing so as to face each other via the signal terminal with a space left therebetween. Further, the upper ground terminal has a contact portion being in contact with a contact inner surface of the shell.

10 Claims, 18 Drawing Sheets

(56) References Cited

U.S. PATENT DOCUMENTS

| | | | | |
|---|---|---|---|---|
| 6,733,310 | B2 * | 5/2004 | Fujikura | H01R 13/2428 439/181 |
| 7,699,663 | B1 * | 4/2010 | Little | H01R 13/65802 439/660 |
| 7,810,235 | B2 * | 10/2010 | Sprouse | H01R 13/6485 29/874 |
| 7,985,096 | B2 * | 7/2011 | Kobayashi | H01R 13/648 439/188 |
| 8,317,528 | B2 * | 11/2012 | Chen | H01R 13/7036 439/188 |
| 8,574,011 | B2 * | 11/2013 | Shih | H01R 27/00 439/660 |
| 8,961,230 | B2 * | 2/2015 | Chou | H01R 9/032 439/607.27 |
| 8,974,240 | B2 * | 3/2015 | Yu | H01R 29/00 439/188 |
| 8,997,345 | B2 * | 4/2015 | Liu | H01R 43/24 29/825 |
| 9,356,404 | B2 * | 5/2016 | Yu | H01R 13/6582 |
| 2004/0018772 | A1 | 1/2004 | Zhang et al. | |
| 2005/0112946 | A1 | 5/2005 | Wan et al. | |
| 2008/0020654 | A1 | 1/2008 | He et al. | |
| 2010/0210124 | A1 * | 8/2010 | Li | H01R 23/6873 439/108 |
| 2012/0276757 | A1 * | 11/2012 | Matsuoka | H01R 13/6594 439/55 |
| 2013/0149902 | A1 * | 6/2013 | Tsuchiya | H01R 12/724 439/607.34 |
| 2014/0051303 | A1 * | 2/2014 | Yu | H01R 13/46 439/660 |
| 2015/0072546 | A1 * | 3/2015 | Li | H01R 13/6585 439/96 |

* cited by examiner

CONNECTOR

This application is based upon and claims the benefit of priority from Japanese Patent Application No. 2015-086740 filed on Apr. 21, 2015, the disclosure of which is incorporated herein in its entirety by reference.

BACKGROUND OF THE INVENTION

This invention relates to a connector.

As described in JP-A-2006-310184 (Patent Document 1), a conventional shielded connector has a structure that enhances the noise resistance by providing a double-structure housing and a double-structure shell.

This conventional shielded connector will be described with reference to FIG. 21. As shown in FIG. 21, a connector 301 of Patent Document 1 includes conductive contacts 311, an insulating inner housing 321 holding the contacts 311, a conductive first shell 331 covering the inner housing 321, an insulating outer housing 341 covering the first shell 331, and a conductive second shell 351 covering the outer housing 341.

DISCLOSURE OF THE INVENTION

However, in such a structure, the two housings and the two shells are required and, in addition, structures or the like for holding those members are separately required. Therefore, there is a problem that it is difficult to miniaturize the connector.

This invention has been made in order to solve the above-mentioned problem and has an object to provide a connector whose miniaturization is easier than before.

In order to achieve the above-mentioned object, an aspect of this invention is a connector comprising: at least one first terminal having conductivity; a housing having insulating property and holding the at least one first terminal; a shell having conductivity and covering the housing; and a second terminal having conductivity and a third terminal having conductivity that are held by the housing so as to face each other via the at least one first terminal with a space left therebetween, wherein the second terminal comprises a contact portion being in contact with a contact inner surface of the shell.

Effect of the Invention

According to this invention, it is possible to provide a connector whose miniaturization is easier than before.

MODE FOR CARRYING OUT THE INVENTION

Hereinbelow, preferred exemplary embodiments of this invention will be described in detail with reference to the drawings.

First, referring to FIGS. 1 and 2, the structure of a connector according to a first exemplary embodiment of this invention will be described. Herein, as the connector 1, there is shown by way of example an angle connector, wherein a direction in which a mating connector 95 (see, FIG. 13) as a fitting object and the connector 1 are fitted to each other is perpendicular to a direction in which the connector 1 is mounted on a board 81 (see, FIG. 13). Details of the mating connector 95 and the board 81 will be described later in conjunction with FIG. 13.

In the illustrated example, a rectangular coordinates system has a first or X direction extending leftward and rightward, i.e., laterally, a second or Y direction extending forward and backward, and a third or Z direction extending upward and downward. The first to the third directions X, Y, and Z are perpendicular to each other. The first or X direction is also called a lateral or width direction. The second or Y direction is also called a fore-and-aft direction. The third or Z direction is also called an up-and-down direction. In addition, the fore-and-aft direction Y is also called a predetermined direction.

Figure 1:
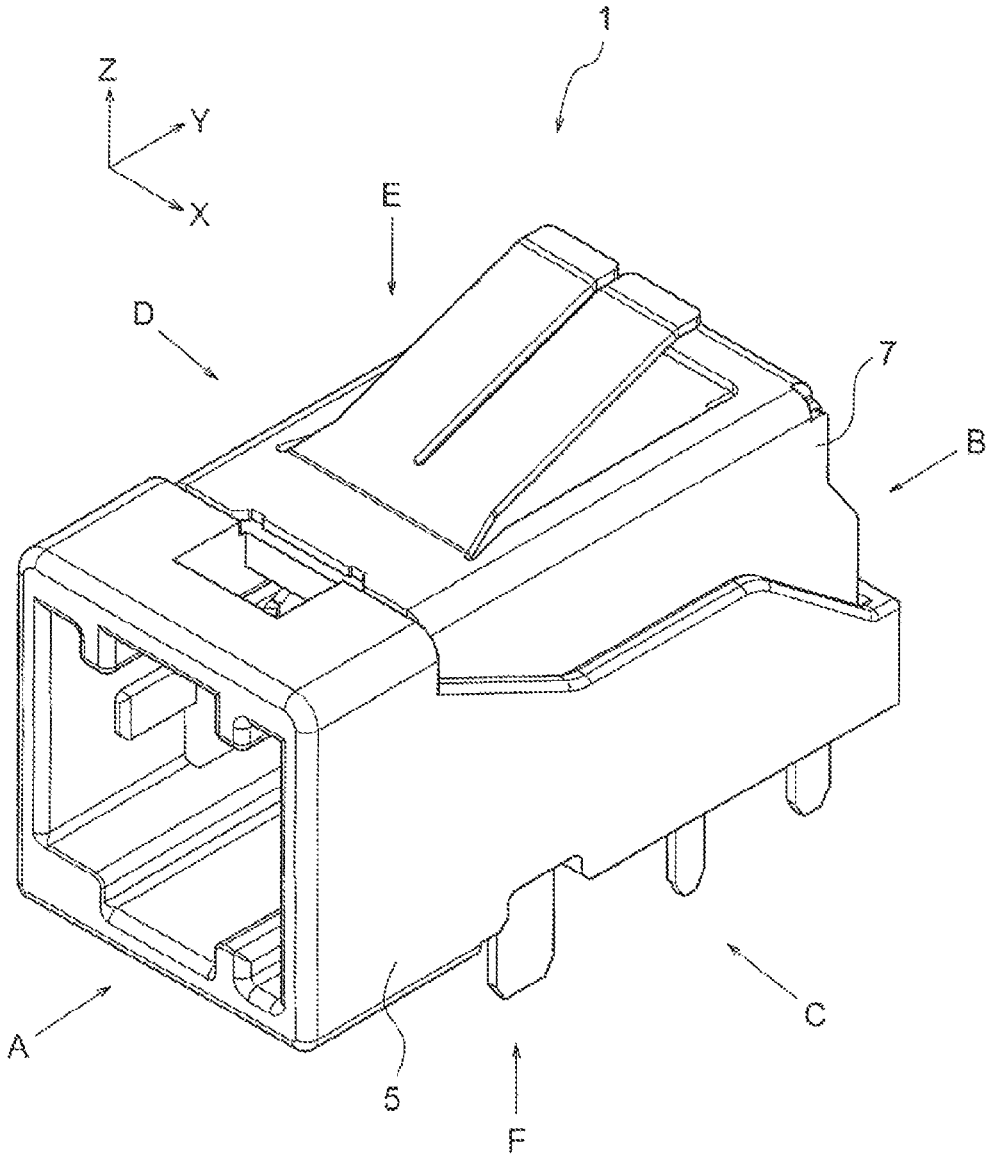
FIG. 1 is a perspective view showing a connector 1 according to a first exemplary embodiment of this invention.

In FIG. 1 the connector 1 has a shape similar to a rectangular parallelepiped (hexahedron). In the following description, it is assumed that a direction A in FIG. 1 is the direction in which the mating connector 95 and the connector 1 are fitted to each other and that a surface, that can be seen in this direction of the connector 1 is a front surface of the connector 1. Likewise, it is assumed that a surface (surface seen in a direction B) facing the front surface is a rear surface, that a surface seen in a direction E is a top surface, that a surface seen in a direction F is a bottom surface, that a surface seen in a direction C is a right side surface, and that a surface seen in a direction D is a left side surface.

Figure 2:
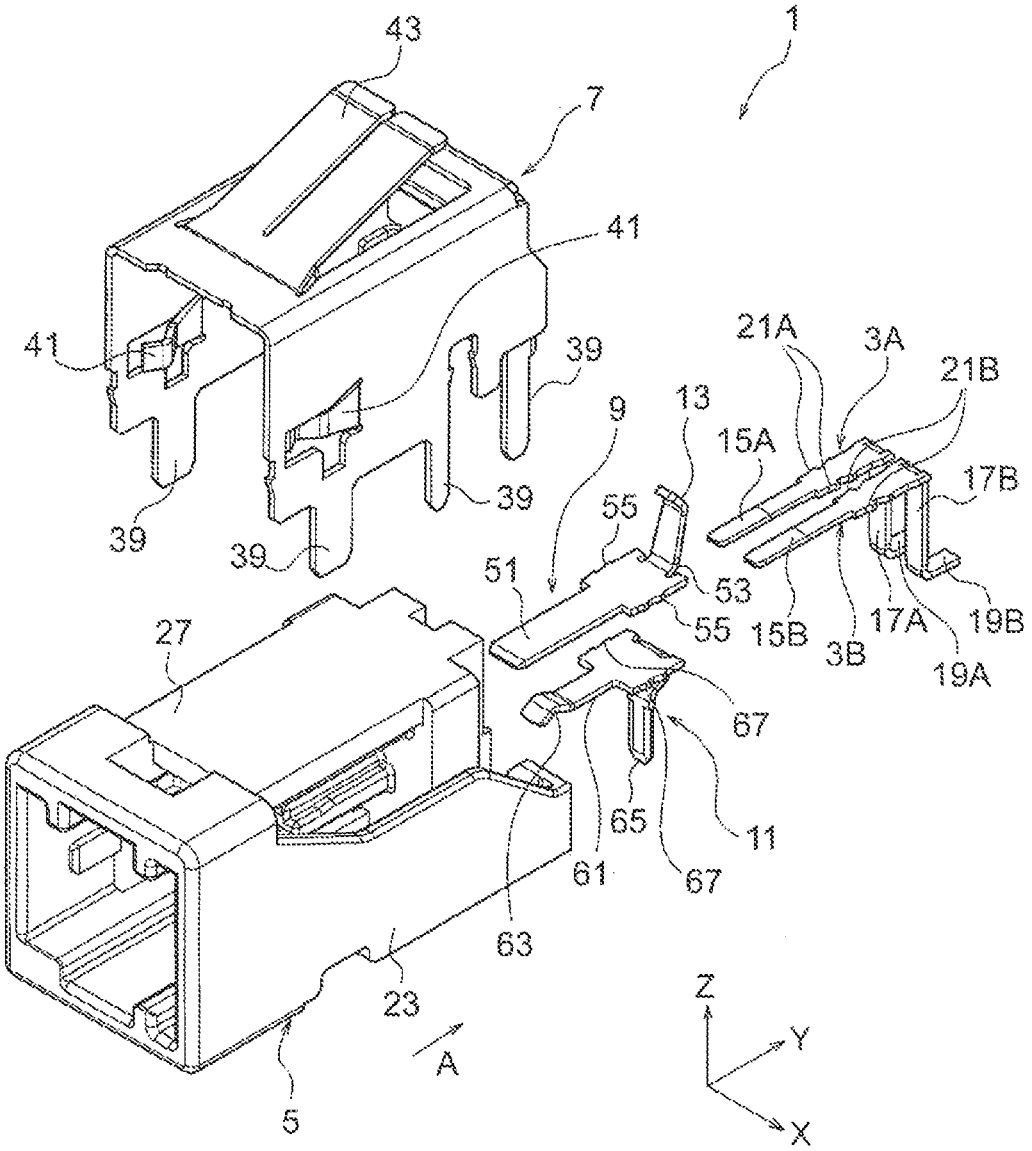
FIG. 2 is an exploded perspective view of FIG. 1.

As shown in FIGS. 1 and 2, the connector 1 includes signal terminals 3A and 3B, a housing 5 having insulating property and holding the signal terminals 3A and 3B, a shell 7 having conductivity and covering the housing 5, and an upper ground terminal 9 and a lower around terminal 11 which are held by the housing 5 so as to face each other via the signal terminals 3A and 3B with a space left therebetween.

Each of the signal terminals 3A and 3B extends in the fore-and-aft direction or the predetermined direction Y and is also called a first terminal having conductivity. The upper ground terminal 9 also extends in the fore-and-aft direction or the predetermined direction and is also called a second terminal having conductivity. The lower ground terminal 11 also extends in the fore-and-aft direction or the predetermined direction Y and is also called a third terminal having conductivity.

Further, the upper ground terminal 9 has a contact portion 13 being in contact with the rear side (a contact inner surface) of the shell 7.

Next, referring to FIGS. 1 to 12, the structures of the respective members forming the connector 1 will be described in further detail.

First, the structure of the signal terminals 3A and 3B will be described with reference to FIGS. 2, 3, 7, 8, 10, and 11.

The signal terminals 3A and 3B are terminals for use in signal conduction via the mating connector 95 and the board 81 and are respectively connected to, for example, contact portions 87 (details will be described later) of the board 81.

As shown in FIGS. 3, 7, 8, 10, and 11, particularly in FIG. 2, each of the signal terminals 3A and 3B has a plate-like shape the extends in fore-and-aft direction or the predetermined direction Y in which the mating connector 95 and the connector 1 are fitted to each other, and that is parallel to the top surface of the connector 1. More specifically, the signal terminals 3A and 3B have plate-like signal terminal mating side connecting portions 15A and 15B for connection to signal terminals of the mating connector 95, and board connecting portions 17A and 17B, respectively, having a shape bent downward from a rear end of the signal terminal mating side connecting portions 15A and 15B (the rear side of the connector 1) and adapted to be connected to the board 81. The plate-like signal terminal mating side connecting portions 15A and 15B extend in the fore-and-aft direction or the predetermined direction Y while the board connecting portions 17A and 17B extend in the up-and-down direction Z. The board connecting portions 17A and 17B have at its open end a shape bent in parallel to the signal terminal mating side connecting portions 15A and 15B, respectively, so as to have signal terminal contact portions 19A and 19B for connection to the contact portions 87 of the board 81 by soldering or the like, respectively. The signal terminal contact portions 19A and 19B extend in the fore-and-aft direction or the predetermined direction Y.

Further, the signal terminal mating side connecting portion 15A is provided on its both lateral sides with signal terminal projecting portions 21A enabling the housing 5 to hold the signal terminal 3. Likewise, the signal terminal mating side connecting portion 15B is provided on its both lateral sides with signal terminal projecting portions 21B for enabling the housing 5 to hold the signal terminal 3B.

The above is a description of the structure of the signal terminals 3A and 3B.

Next, the structure of the housing 5 will described with reference to FIGS. 3 to 9, particularly to FIG. 3.

The housing 5 is made of an insulating resin or the like for holding the signal terminals 3A and 3B, the shell 7, the upper ground terminal 9, and the lower ground terminal 11.

Figure 3:
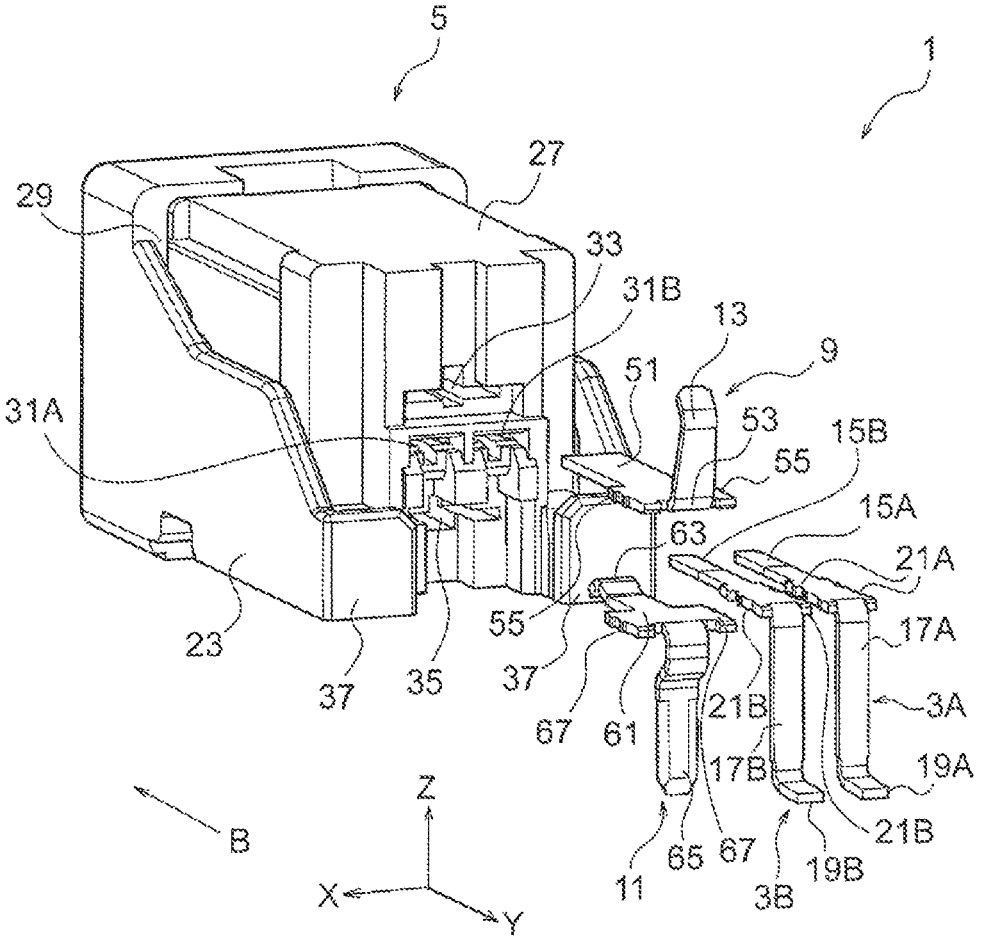
FIG. 3 is an exploded perspective view seeing FIG. 2 from the rear side of a housing 5, wherein illustration of a shell 7 is omitted.
Figure 4:
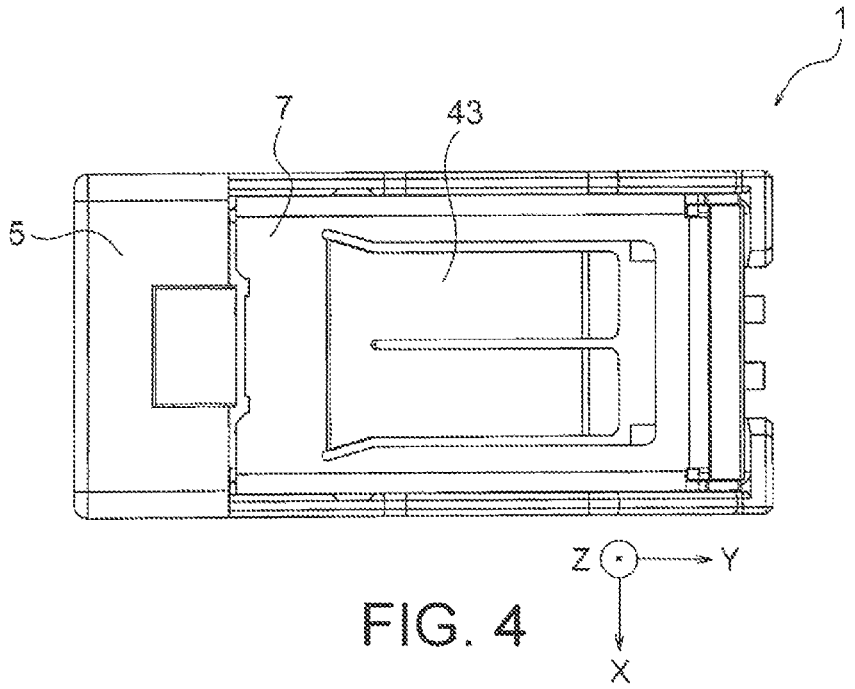
FIG. 4 is a top view of FIG. 1.
Figure 5:
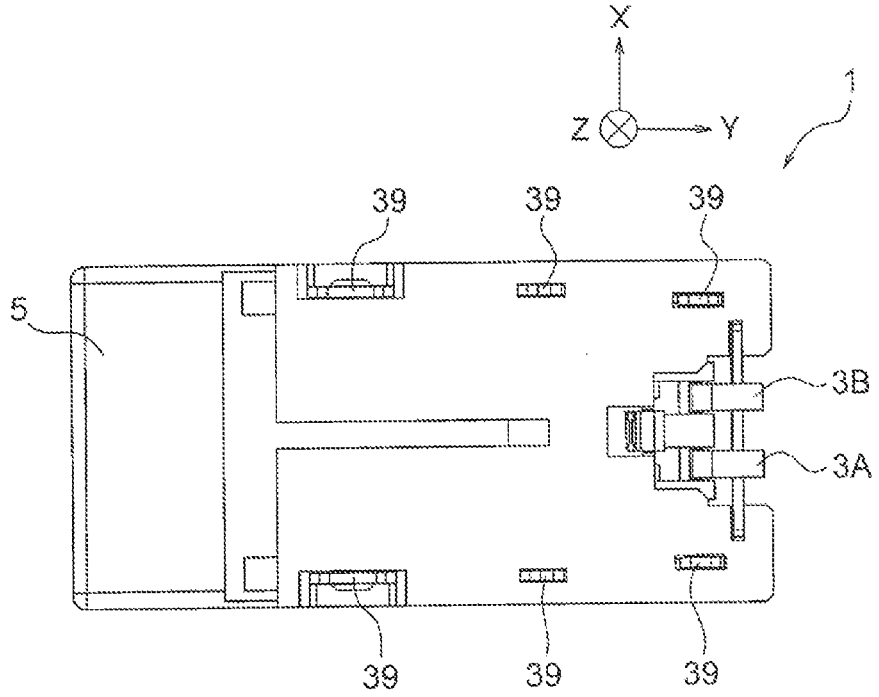
FIG. 5 is a bottom view of FIG. 1.
Figure 6:
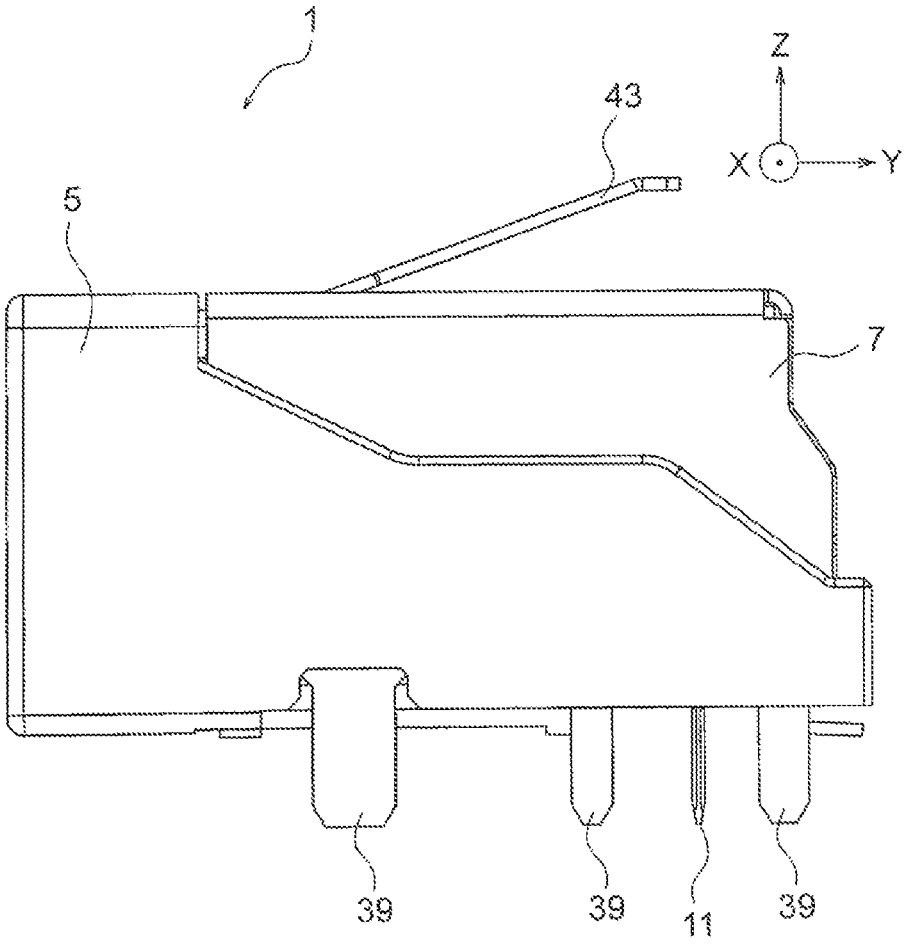
FIG. 6 is a right side view (C-direction arrow view) of FIG. 1.
Figure 7:
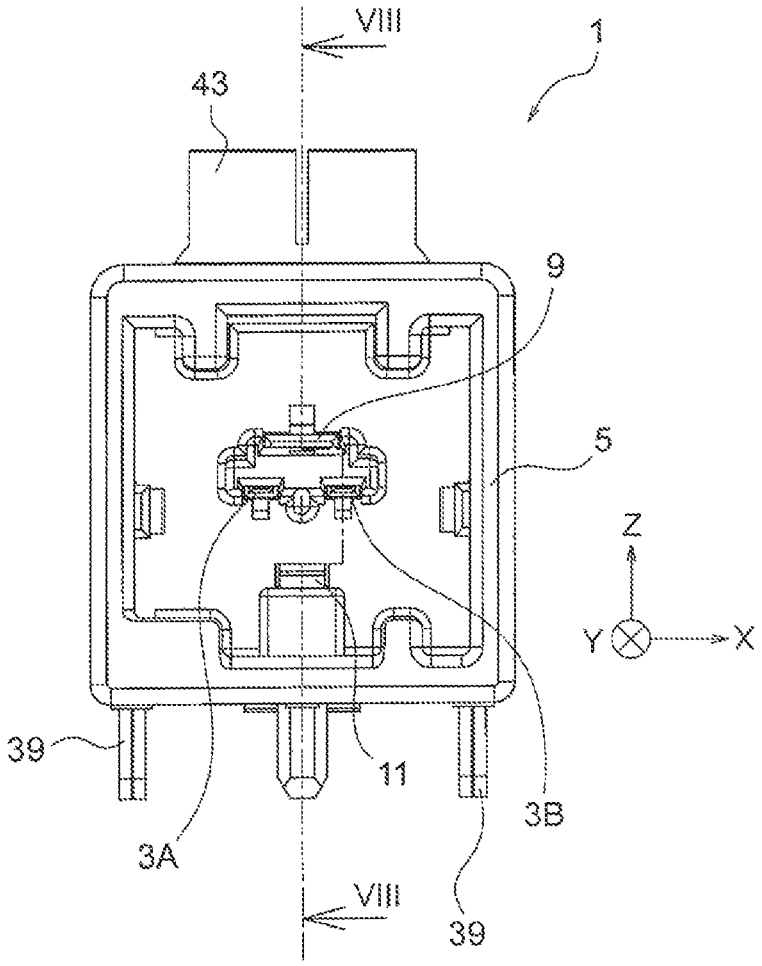
FIG. 7 is a front view (A-direction arrow view) of FIG. 1.

As shown in FIG. 3, the housing 5 includes an outer insulating shell 23 having a shape similar to a rectangular parallelepiped extending in the fore-and-aft direction or the predetermined direction Y in which the mating connector 95 and the connector 1 are fitted to each other. The outer insulating shell 23 has a front surface that is opened as an open surface 25 (see FIG. 8) into which the mating connector 95 is inserted. A top surface, left and right side surfaces, and a rear surface of the outer shell 23 are also opened partially.

The housing 5 further includes a rectangular parallelepiped inner insulating shell 27 located in the outer insulating shell 23. The inner insulating shell 27 is integrated at its front surface with the outer insulating shell 23, while the dimensions of respective sides, forming the rectangular parallelepiped, of the inner insulating shell 27 are smaller than those of the outer insulating shell 23. Accordingly, a gap 29 is formed between the inner insulating she 27 and the outer insulating shell 23. The gap 29 has a dimension corresponding to the thickness of the she 7 so that the shell 7 is held by the housing 5 by inserting the shell 7 into the gap 29.

Figure 8:
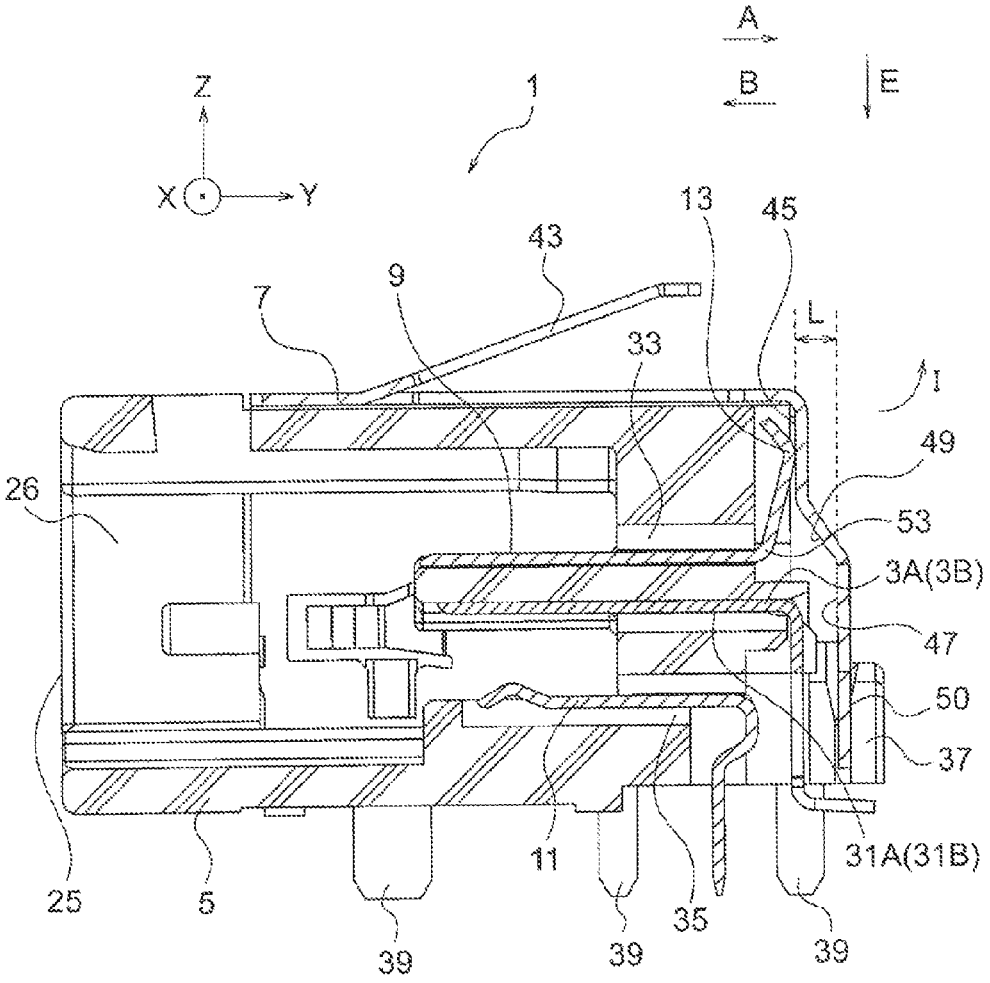
FIG. 8 is a VIII-VIII sectional view of FIG. 7.

As shown in FIG. 8, the housing 5 has therein a receiving portion 26 which is a space formed from the open surface 25 toward the rear side for receiving the mating connector 95 therein.

Further, as shown in FIG. 3, the housing 5 has signal terminal insertion holes 31A and 31B which are formed to pass through from the front surface to the rear surface and into which the signal terminals 3A and 3B are respectively inserted.

Further, as shown in FIG. 3, the housing has an upper ground terminal insertion hole 33 which is formed to pass through from the front surface to the rear surface and into which the upper ground terminal 9 is inserted. Likewise, the housing 5 has a lower ground terminal insertion hole 35 which is formed to pass through from the front surface to the rear surface and into which the lower ground terminal 11 is inserted.

Herein, the rear surface of the outer insulating shell 23 will be referred to as a "backup portion 37".

As described above, since the housing 5 has the structure in which the outer insulating shell 23 and the inner insulating shell 27 are integrated together, the connector 1 can be easily miniaturized compared to the case where the two housings are separately provided.

The above is a description of the structure of the housing 5.

Next, the structure of the shell 7 will be described with reference to FIGS. 2, 6, 8, and 10 to 12, particularly to FIGS. 2 and 8.

The shell 7 is a member for shielding the signal terminals 3A and 3B of the connector 1 from external electrical noise and for establishing grounding of the upper ground terminal 9.

More specifically, as shown in FIG. 2, the shell 7 has a box shape with its front surface and bottom surface opened.

Portions of lower end portions of left and right side surfaces of the shell 7 form plate-like shell-side ground terminals 39 (herein a plurality of terminals 39 on both sides, respectively) for connection to ground of the board 81.

Further, each of the left and right side surfaces of the shell 7 is partially cut and bent inward to form a cantilever inner contact portion 41 for contact with a shell or the like of the mating connector 95.

Further, a to surface of the shell 7 is partially cut and bent outward to form a shell-side ground connecting portion 43 for connection to a ground terminal of a unit housing 89 (see, FIG. 13) that receives the connector 1. The structure of the unit housing 89 will be described later in conjunction with FIG. 13.

Further, as shown in FIG. 8, a rear inner surface of the shell 7 has a contact inner surface 45 that is in contact with the contact portion 13 of the upper ground terminal 9, and a non-contact inner surface 47 provided forward of the contact surface 45 in a down direction (direction E in FIG. 8) in which the shell 7 is mounted on the housing 5.

The non-contact inner surface 47 protrudes more than the contact inner surface 45 by a distance L in an aft direction (direction A in FIG. 8) in which the contact portion 13 contacts the contact inner surface 45. In the down direction E of FIG. 8, an inclined inner surface 49 inclined from a front end of the contact inner surface 45 to a rear end of the non-contact inner surface 47 is provided between the contact inner surface 45 and the non-contact inner surface 47.

The reason for the contact inner surface 45, the non-contact inner surface 47, and the inclined inner surface 49 to have such shapes will be briefly explained herein. Details will be described later. Since the contact portion 13 of the upper round terminal 9 elastically contacts the shell 7, the contact portion 13 is displaced in the fore direction B from an initial state (a state where the shell 7 is removed from FIG. 8, i.e. a state where the shell 7 and the contact portion 13 are not in contact with each other) upon contacting the shell 7. Therefore, when the shell 7 is removed from the state of FIG. 8, the position of the contact portion 13 returns to the position of the initial state before the displacement. Specifically, the position of the contact portion 13 returns in the aft direction A compared to the position thereof shown in FIG. 8.

In this state (initial state), unless the non-contact inner surface 47 protrudes in the aft direction A more than the contact inner surface 45, i.e. if the distance L is 0, when the shell 7 is lowered in the down direction E so as to be attached to the housing 5, there is a possibility that a front end of the non-contact inner surface 47 of the shell 7 first contacts the contact portion 13 to deform and damage the contact portion 13.

On the other hand, in the case of the structure of FIG. 8, when the shell 7 is lowered in the down direction E so as to be attached to the housing 5, the contact inner surface 45 and the contact portion 13 can be brought into elastic contact with each other using the inclined inner surface 49 as a guide without contacting the front end of the non-contact inner surface 47 of the shell 7 with the contact portion 13.

In order to prevent the front end of the non-contact inner surface 47 of the shell 7 from contacting the contact portion 13 when attaching the shell 7, the distance L is preferably greater than a displacement of the contact portion 13 in the fore direction B in FIG. 8 from the initial state where the contact portion 13 and the shell 7 are not in contact with each other until the state (state of FIG. 8) where the contact portion 13 and the shell 7 are in contact with each other.

The above is a description of the structure of the shell 7.

Next, the structure of the upper ground terminal 9 will be described with reference to FIGS. 2, 3, 8, 10, and 11.

The upper ground terminal 9 has a function as a ground terminal to be grounded by connection to female ground of the mating connector 95 (see, FIG. 13) and also has a function to shield the signal terminals 3A and 3B from external electrical noise jointly with the lower ground terminal 11.

As shown in FIGS. 2, 3, 7, 8, 10, and 11, particularly in FIG. 2, the upper ground terminal 9 has a plate-like shape that extends in the fore-and-aft direction or the predetermined direction Y in which the mating connector 95 and the connector 1 are fitted to each other, and that is parallel to the top surface of the connector 1. More specifically, the upper ground terminal 9 has a plate-like upper terminal mating side connecting portion 51 for connection to ground of the mating connector 95, and a portion having a shape bent upward from a rear end of the upper terminal mating side connecting portion 51 (the rear side of the connector 1). The plate-like upper terminal mating side connecting portion 51 extends in the fore-and-aft direction or the predetermined direction Y. The portion bent upward has elasticity and has a terminal-side elastic portion 53 that presses the contact portion 13 into contact with the shell 7, and the contact portion 13 provided at an open end of the terminal-side elastic portion 53 and elastically contacting the contact inner surface 45 of the shell 7.

Further, the upper terminal mating side connecting portion 51 is provided on its both lateral sides with upper terminal projecting portions 55 for enabling the housing 5 to hold the upper ground terminal 9.

Herein, the upper ground terminal 9 is in contact with the shell 7 and is grounded to the board 81 (see, FIG. 13) and the unit housing 89 (see, FIG. 13), which hold the connector 1, via the shell-side ground terminals 39 and the shell-side ground connecting portion 43 of the shell 7, respectively.

Therefore, in the connector 1, it is not necessary to separately provide members for directly grounding she upper ground terminal 9 to the board 81 and the unit housing 89. Accordingly, the connector 1 is of the structure that can be miniaturized more easily than before.

The above is a description of the structure of the upper ground terminal 9.

Next, the structure of the lower ground terminal will be described with reference to FIGS. 2, 3, 7, 8, 10, and 11.

The lower ground terminal 11 has a function as a ground terminal to be grounded by connection to ground of the mating connector 95 (see, FIG. 13) and also to ground of the board 81 and also has a function to shield the signal terminals 3A and 3B from external electrical noise jointly with the upper ground terminal 9.

As shown in FIGS. 2, 3, 7, 8, 10, and 11, particularly in FIG. 2, the lower ground terminal 11 has a plate-like shape that extends in the fore-and-aft direction or the predetermined direction Y in which the mating connector 95 and the connector 1 are fitted to each other, and that is parallel to the top surface of the connector 1. More specifically, the lower ground terminal 11 has a lower elastic portion 61 for elastic contact with ground of the mating connector 95, and a connection protruding portion 63 of a mountain shape provided at a front end of the lower elastic portion 61 (the front side of the connector 1) and bent so as to protrude to the upper ground terminal 9 side at its middle portion. The lower elastic portion 61 extends in the fore-and-aft direction or the predetermined direction Y. The lower ground terminal 11 further has an inserting portion 65 having a shape bent downward from a rear end of the lower elastic portion 61 (the rear side of the connector 1) and adapted to be inserted into a grounding through hole or the like of the board 81 (see, FIG. 13). The inserting portion 65 extends in the up-and-down direction Z.

Further, the lower elastic portion 61 is provided on its both lateral sides with lower terminal projecting portions 67 for enabling the housing 5 to hold the lower round terminal 11.

The above is a description of the structure of the lower ground terminal 11.

Next, a method of assembling the connector 1 will be described.

First, the upper ground terminal 9, the lower ground terminal 11, and the signal terminals 3A and 3B are attached to the housing 5.

Specifically, the upper terminal mating side connecting portion 51 of the upper ground terminal 9 is faced toward the rear surface of the housing 5 as shown in FIG. 3 and then is inserted into the upper ground terminal insertion hole 33 from the rear side of the housing 5, and then the upper terminal projecting portions 55 are engaged with the housing so as to be held by the housing 5.

Likewise, the lower elastic portion 61 of the lower ground terminal 11 is faced toward the rear surface of the housing 5 and then is inserted into the lower ground terminal insertion hole 35 from the rear side of the housing 5, and then the lower terminal projecting portions 67 are engaged with the housing 5 so as to be held by the housing 5.

Further, the signal terminal mating side connecting portions 15A and 15B of the signal terminals 3A and 3B are faced toward the rear surface of the housing 5 and then are inserted into the signal terminal insertion holes 31A and 31B from the rear side of the housing 5, and then the signal terminal projecting portions 21A and 21B are engaged with the housing 5 so as to be held by the housing 5.

Then, the shell 7 is mounted on the housing 5 so that the contact portion 13 of the upper ground terminal 9 and the contact surface 45 of the shell 7 are brought into contact with each other.

Specifically, by disposing the shell 7 above the housing 5 (see FIG. 2) and then inserting the shell 7 into the gap 29 shown in FIG. 3, the shell 7 is mounted on and held by the housing 5. In this event, the contact portion 13 elastically contacts the contact inner surface 45 using the inclined inner surface 49 as a guide as described above.

In this way, the connector 1 is completed.

Figure 9:
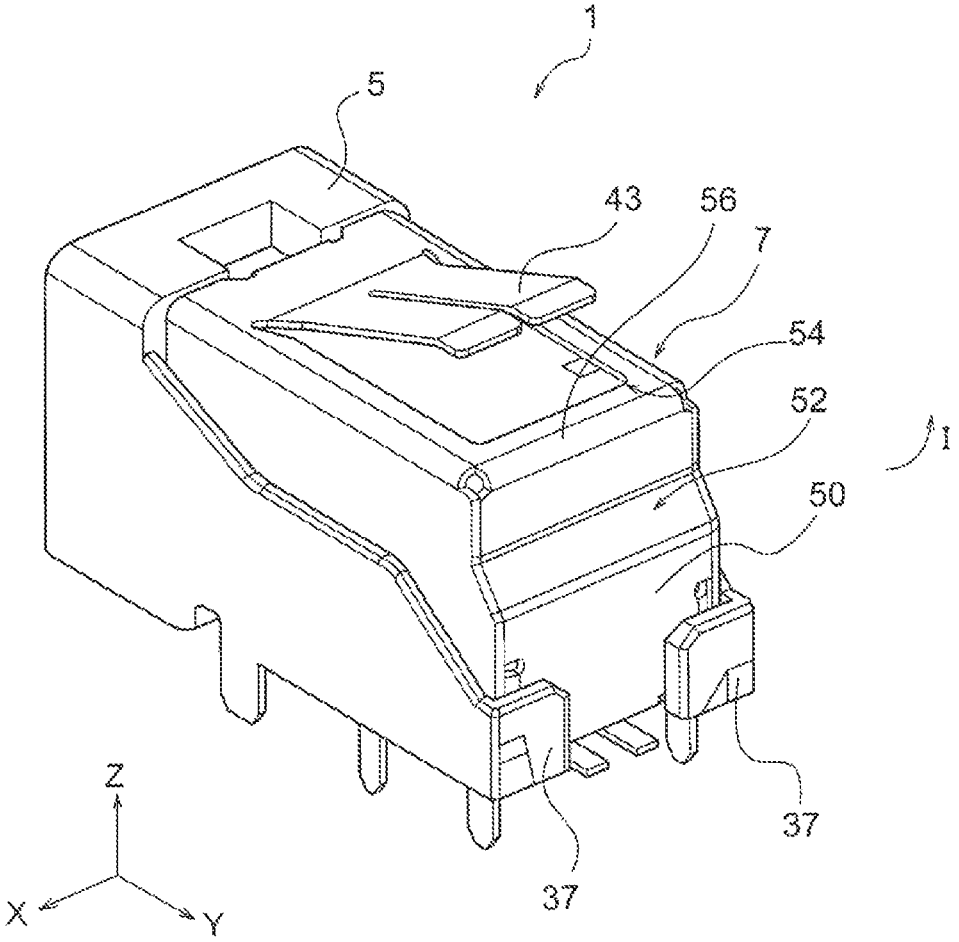
FIG. 9 is a perspective view seeing FIG. 1 from the rear side of the shell 7.
Figure 10:
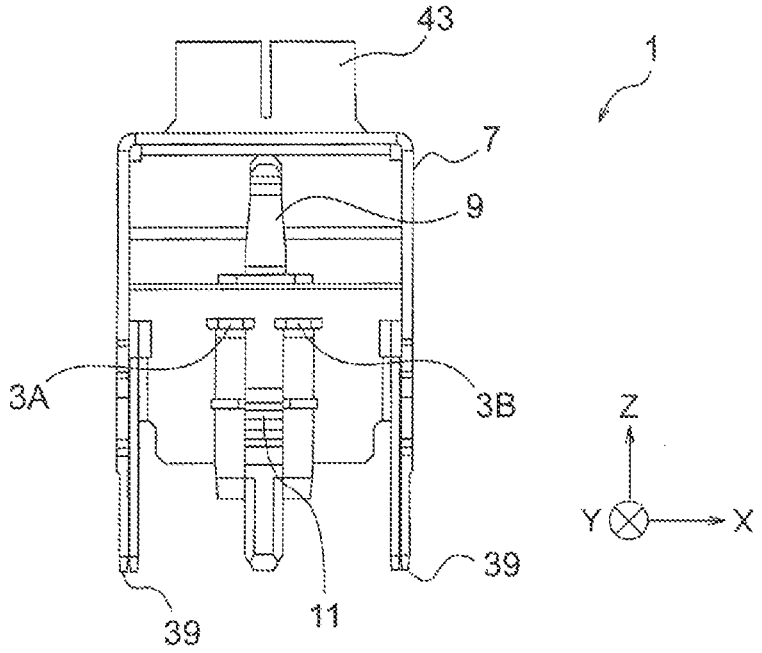
FIG. 10 is a diagram in which illustration of the housing 5 is omitted in FIG. 7.
Figure 11:
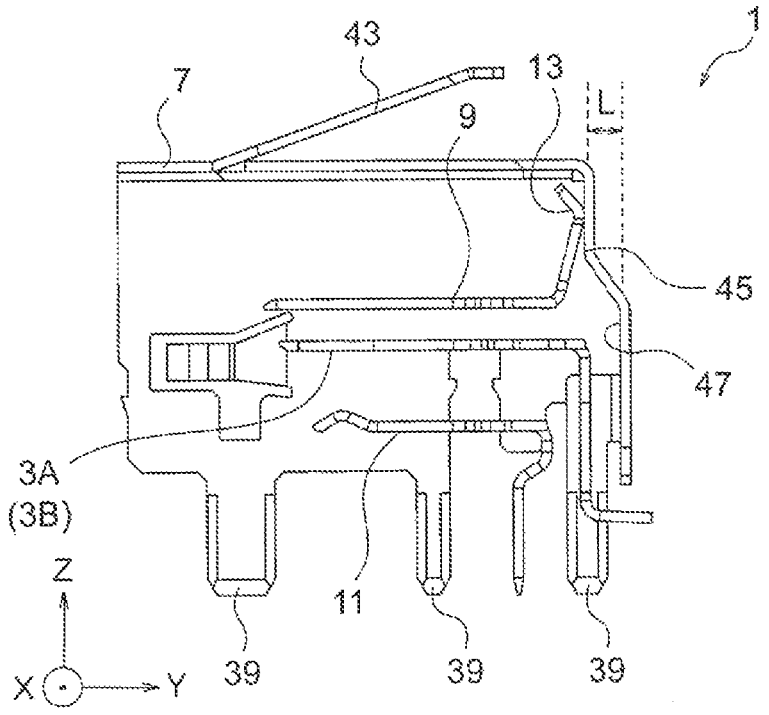
FIG. 11 is a diagram in which illustration of the housing 5 is omitted in FIG. 8.

In the connector 1, since the contact portion 13 of the upper round terminal 9 and the shell 7 are in elastic contact with each other by the terminal-side elastic portion 53, the shell 7 receives a pressure from the terminal-side elastic portion 53 in the aft direction A in FIG. 8. Herein, since the shell 7 is formed, for example, by bending a metal plate into a box shape, a rear surface plate 52 of the shell 7 is directly connected to only a top surface plate 54 of the shell 7 as shown in FIG. 9. Therefore, when the rear surface plate 52 of the shell 7 receives the pressure from the terminal-side elastic portion 53 of the upper ground terminal 9, there is a possibility that the rear surface plate 52 is rotated in a direction I in FIGS. 8 and 9 using a connecting portion 56 of the shell 7 with the top surface plate 54 as a fulcrum so that the shell 7 is opened.

However, as shown in FIGS. 8 and 9, the backup portion 37 is provided at the rear surface of the housing 5 so as to contact an outer surface 50, on the side opposite to the contact inner surface 45, of the shell 7, and therefore, the backup portion 37 prevents the rear surface plate 52 of the shell 7 from being rotated in the direction I in FIGS. 8 and 9 against the pressure from the terminal-side elastic portion 53 of the upper ground terminal 9.

Figure 12:
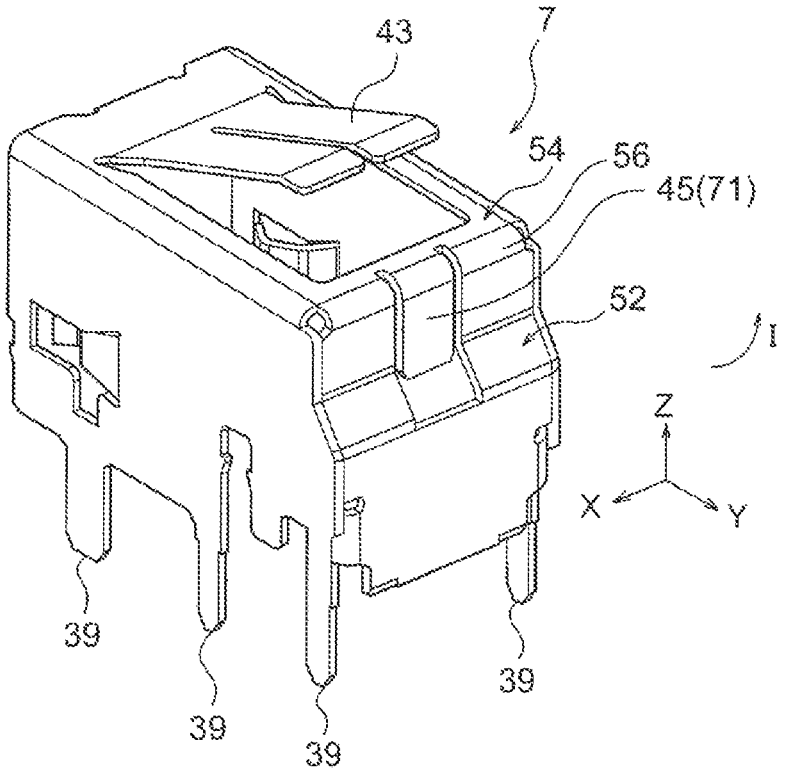
FIG. 12 is a diagram showing a modification of the shell 7.

Without providing the backup portion 37, for example, as shown in FIG. 12, a contact inner surface 45 of the shell 7 may be formed by a slit reaching a top surface plate 54 at its roots, thereby providing a spring-like shell-side elastic portion 71 that is elastically deformed in a direction in which a terminal-side elastic portion 53 of the upper ground terminal 9 applies a pressure. In this case, the spring-like shell-side elastic portion 71 is elastically deformed so as to at the pressure from the terminal-side elastic portion 53 of the upper ground terminal 9, thereby preventing a rear surface plate 52 of a shell 7 from being rotated in a direction I in FIG. 12. In the case of the structure in which the shell 7 has the shell-side elastic portion 71, since the shell-side elastic portion 71 is elastically deformed in the state where the contact portion 13 of the upper ground terminal 9 and the shell 7 are in contact with each other, the terminal-side elastic portion 53 is not necessarily elastically deformed. Accordingly, in the case where the shell 7 is provided with the shell-side elastic portion 71, a portion corresponding to the terminal-side elastic portion 53 may be configured not to be elastically deformable.

Next, the sequence of attaching the connector 1 to the board 81 and the sequence of connecting the connector 1 to the mating connector 95 will be described with reference to FIG. 13.

First, the connector 1 is attached to the board 81.

Specifically, first, the shell-side ground terminals 39 of the shell 7 and the inserting portion 65 of the lower ground terminal 11 are inserted into through holes 83 and 85 having ground terminals, grounded, of the board 81 and are fixed therein.

Then, the signal terminal contact portions 19A and 19B of the signal terminals 3A and 3B are connected by soldering or the like to the contact portions 87 connected to a signal circuit or the like of the board 81.

Then, the board 81 and the connector 1 are covered by the unit housing 89, which is a cover for covering the board 81 and the connector 1, and the shell-side ground connecting portion 43 of the shell 7 is connected to a ground terminal 91 of the unit housing 89. The ground terminal 91 is connected to ground of a device (not shown) mounted with the connector 1. In this way, the connector 1 is attached to the board 81.

Then, the connector 1 is connected to the mating connector 95.

Specifically, the mating connector 95 is inserted into the connector 1 through an opening 93 of the unit housing 89 and from the open surface 25 side of the housing 5 and a female ground 97 of the mating connector 5 is connected to the upper terminal mating side connecting portion 51 of the upper ground terminal 9. Likewise, the female ground 7 of the mating connector 95 is connected to the connection protruding portion 63 of the lower ground terminal 11. In this way, the connector 1 and the mating connector 95 are grounded so that the ground constituent components (the female ground 97, the upper ground terminal 9, the lower ground terminal 11, and the shell 7) have the same potential.

In this case, there are the following first through third ground lines as ground lines.

Figure 13:
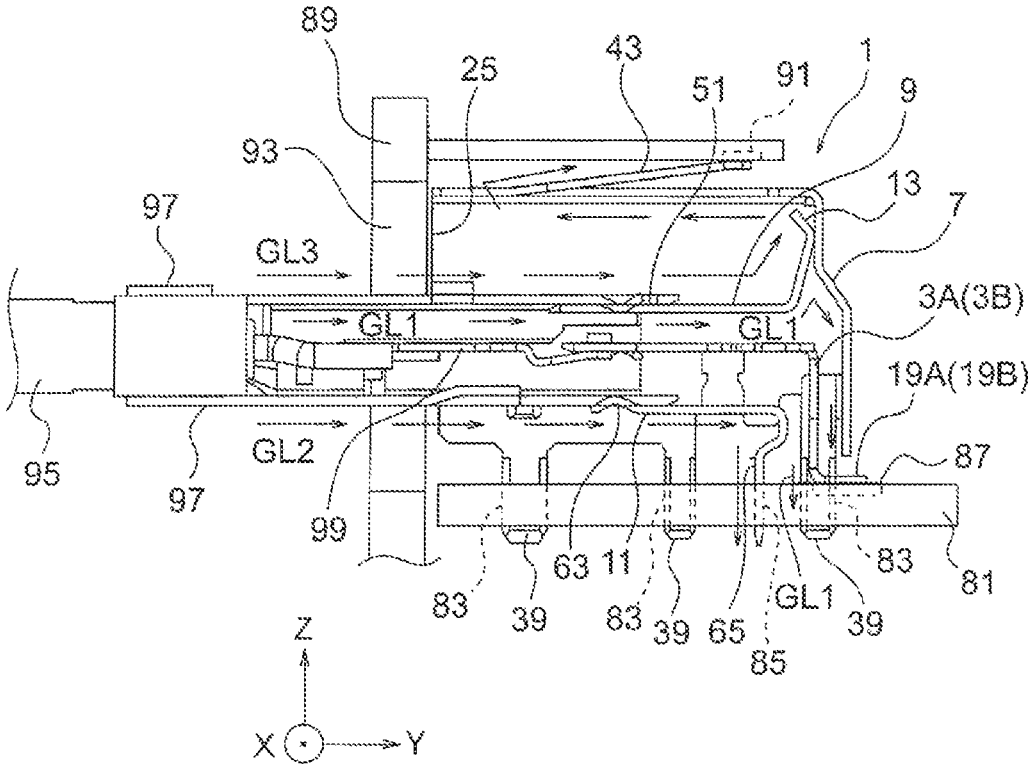
FIG. 13 is a diagram showing a state where the connector 1 is connected to a board 81, a unit housing 89, and a mating connector 95.
Figure 14:
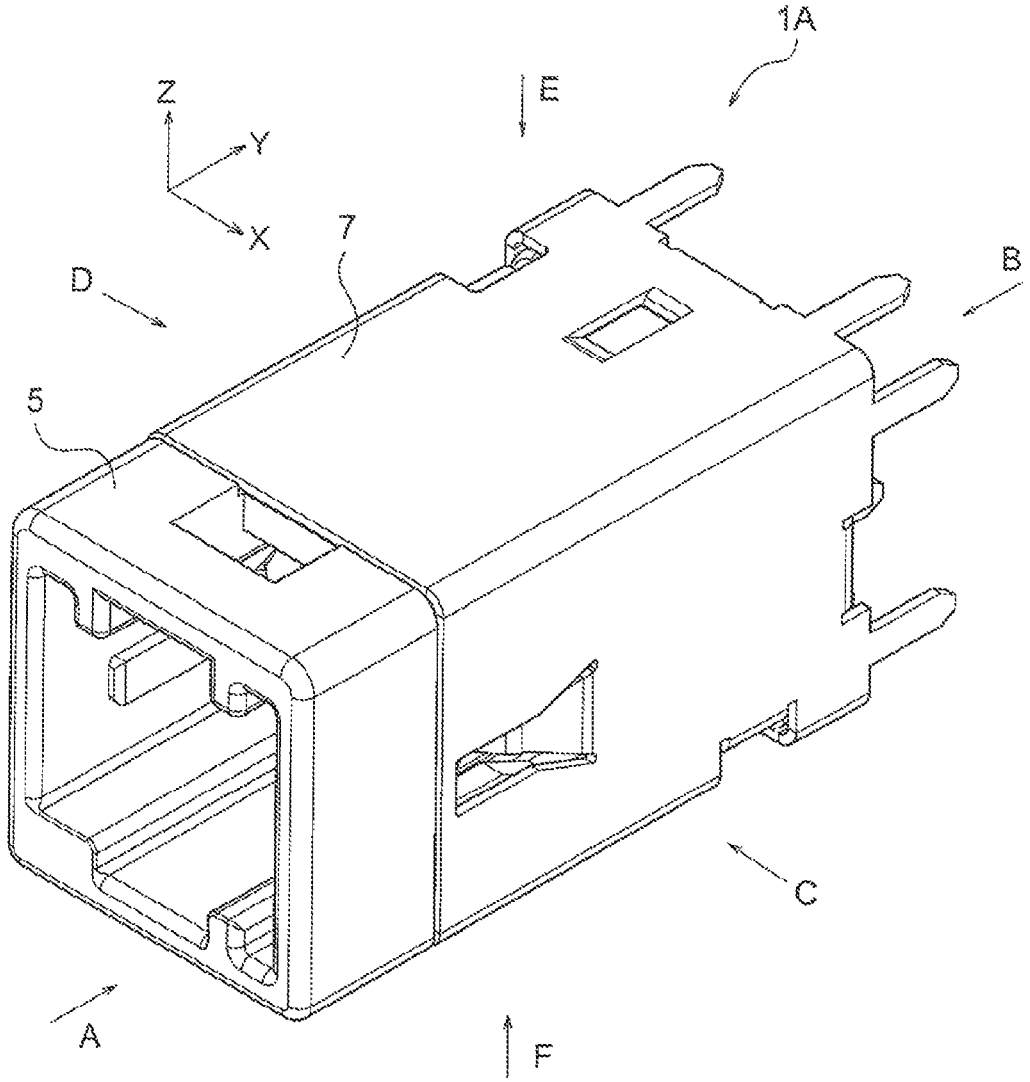
FIG. 14 is a perspective view showing a connector 1A according to a second exemplary embodiment of this invention.

The first ground line is a line that reaches the through holes 83 of the board 81 via the female ground 97, the upper ground terminal 9, the shell 7, and the shell-side ground terminals 39 of the shell 7, and is indicated as GL1 in FIG. 13.

The second ground line is a line that reaches the through hole 85 of the board 81 via the female ground 97 and the lower ground terminal 11, and is indicated as GL2 in FIG. 13.

The third ground line is a line that reaches the ground terminal 91 of the unit housing 89 via the female ground 97, the upper ground terminal 9, the shell 7 and the shell-side ground connecting portion 43 of the shell 7, and is indicated as GL3 in FIG. 13.

Signal terminals 99 of the mating connector 95 are connected to the signal terminal mating side connecting portions 15A and 15B of the signal terminals 3A and 3B of the connector 1.

In this structure, while the shell 7 mainly has a function to shield the signal terminals 3A and 3B from external electrical noise the shell 7 also contributes to establishing the first and the third ground lines GL1 and GL3 and thus also has a function of potential equalization of the ground constituent components.

On the other hand while the upper ground terminal 9 and the lower ground terminal 11 contribute to establishing the first through the third ground lines GL1, GL2, and GL3 and thus mainly have a function of potential equalization of the ground constituent components, since the upper ground terminal 9 and the lower ground terminal 11 face each other via the signal terminals 3A and 3B (and the housing 5), the upper ground terminal 9 and the lower ground terminal 11 also have a function to shield the signal terminals 3A and B from external electrical noise.

Accordingly, the connector can be easily miniaturized while maintaining the two functions of shielding from external electrical noise and of potential equalization of the ground constituent components at the same level compared to the case where the double-structure shell is provided.

The above is a description of the sequence of attaching the connector 1 to the board 81 and the sequence of connecting the connector 1 to the mating connector 95.

As described above, according to the first exemplary embodiment, the connector 1 includes the signal terminals 3A and 3B as the at least one first terminal having conductivity, the housing 5 having insulating property and holding the signal terminals 3A and 3B, the shell 7 having conductivity and covering the housing 5, and the upper ground terminal 9 as the second terminal having conductivity and the lower ground terminal 11 as the third terminal having conductivity which are held by the housing 5 so as to face each other via the signal terminals 3A and 3B with a space left therebetween, wherein the upper ground terminal 9 has the contact portion 13 being in contact with the contact inner surface 45 of the shell 7.

Accordingly, the connector can be miniaturized more easily than before.

Next, a second exemplary embodiment of this invention will be described with reference to FIGS. 14 to 20.

In the second exemplary embodiment, a connector 1A is a straight connector, wherein a direction in which the connector 1A is fitted to a mating connector 95 is parallel to a direction in which the connector 1A is mounted on a board 81.

In the second exemplary embodiment, components that perform the same functions as those in the first exemplary embodiment are assigned the same symbols and a description will be mainly given of portions different from the first exemplary embodiment.

As shown in FIGS. 14 to 20, the connector 1A according to the second exemplary embodiment has the same structure as the connector 1 according to the first exemplary embodiment except that the connector 1A is the straight connector.

However, since to connector 1A is the straight connector, the connector 1A differs from the connector 1 in the following structure.

Figure 15:
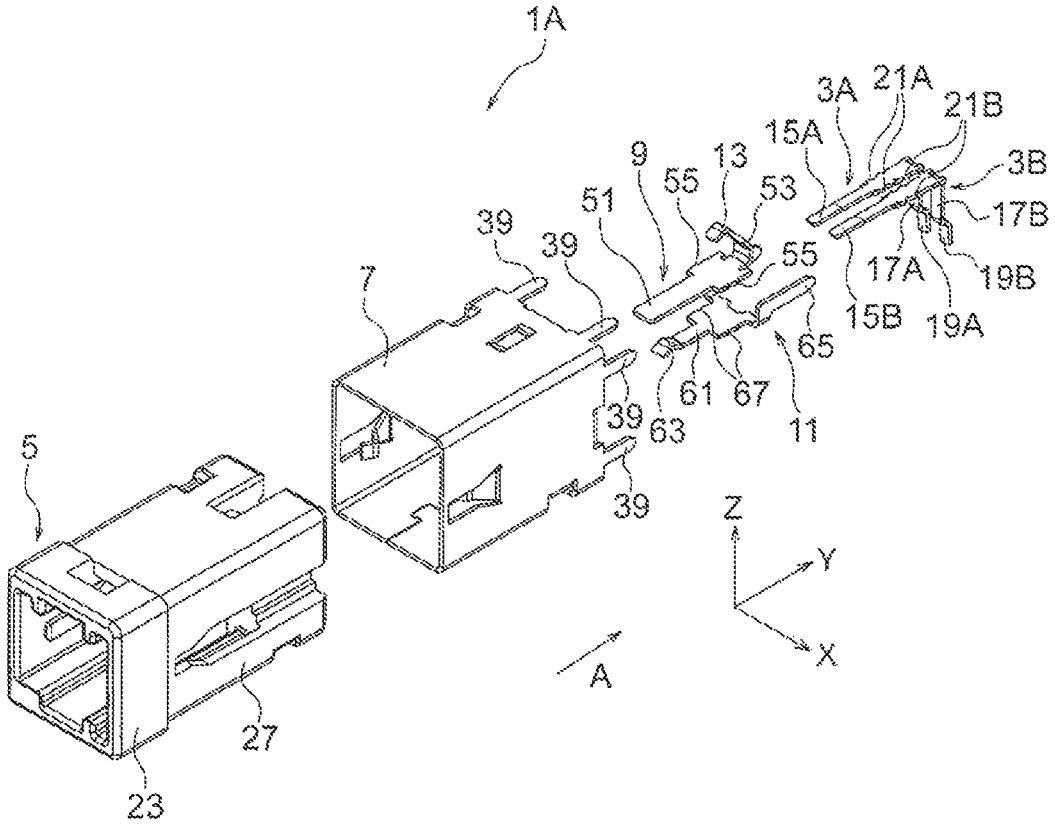
FIG. 15 is an exploded perspective view of FIG. 14.
Figure 16:
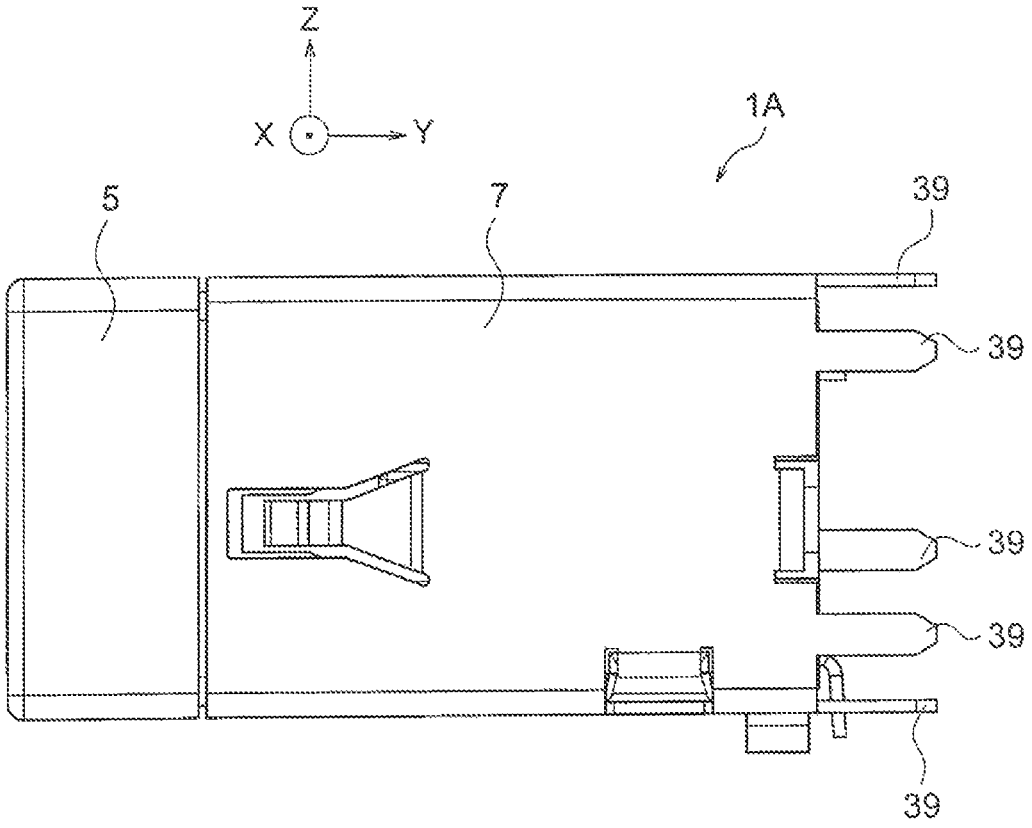
FIG. 16 is a right side view (C-direction arrow view) of FIG. 14.
Figure 17:
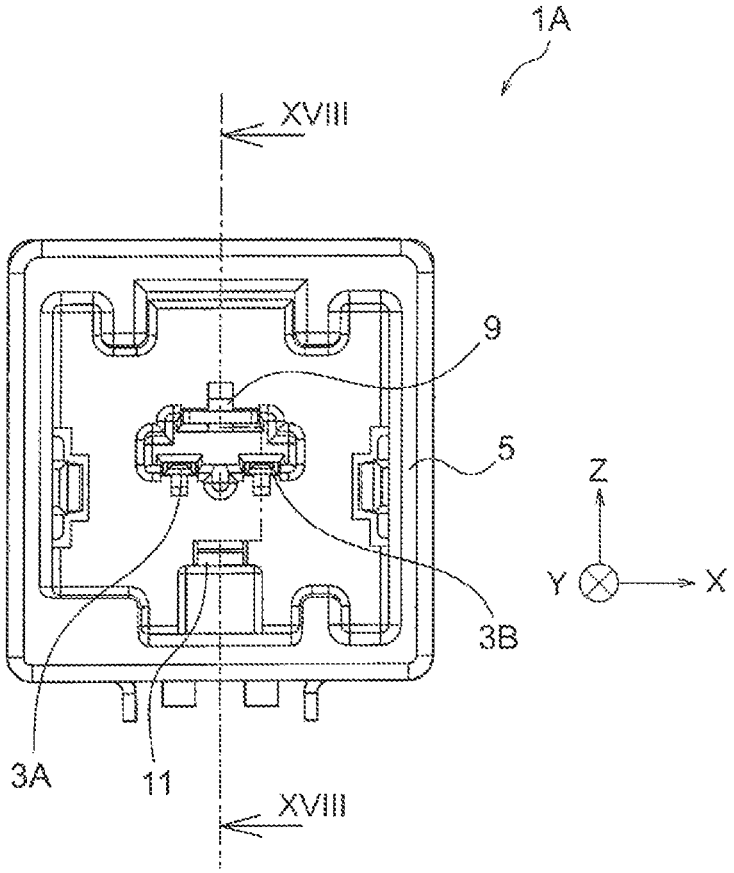
FIG. 17 is a front view (A-direction arrow view) of FIG. 14.

First, in signal terminals 3A and 3B, as shown in FIG. 15, signal terminal contact portions 19A and 19B are perpendicular to signal terminal mating side connecting portions 15A and 15B and parallel to board connecting portions 17A and 17B, respectively.

Next, as shown in FIG. 15, a housing 5 has a structure in which an outer insulating shell 23 and an inner insulating shell 27 are connected to each other in series in a fore-and-aft direction (direction A in FIG. 15) in which the connector 1A and the mating connector 95 are fitted to each other, wherein the dimension of each of short sides forming a rectangular parallelepiped of the inner insulating shell 27 is smaller by the thickness of a shell 7 having conductivity.

As shown in FIG. 15, the shell 7 has a shape with its front surface and rear surface opened and covers the inner insulating shell 27 except its rear surface.

Figure 18:
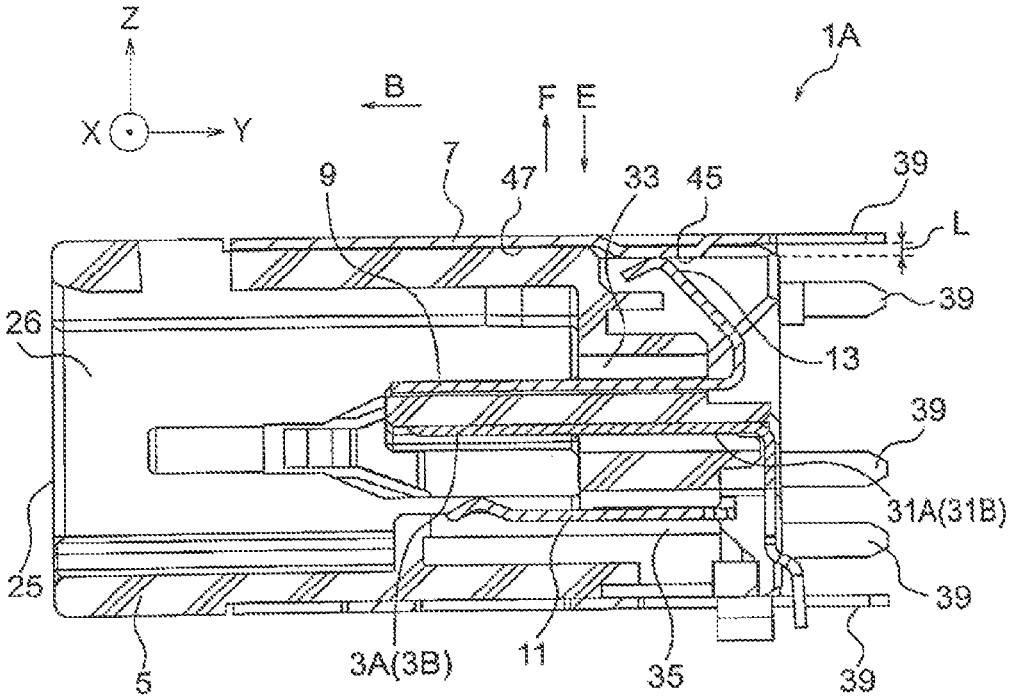
FIG. 18 is an XVIII-XVIII sectional view of FIG. 17.
Figure 19:
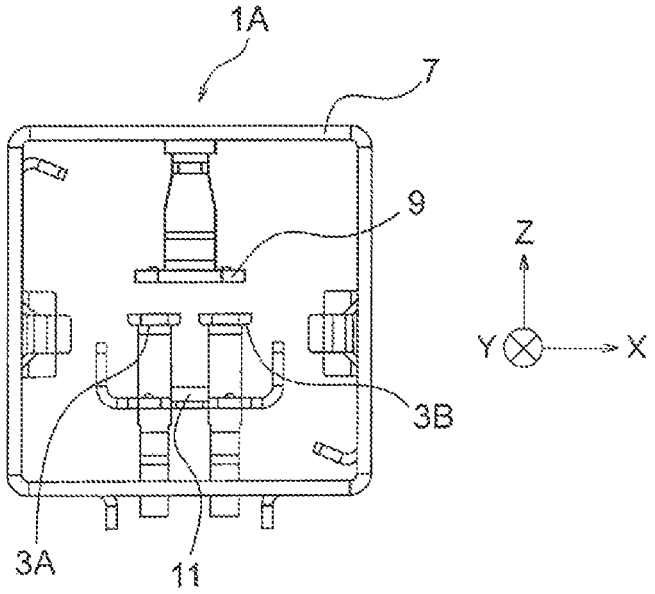
FIG. 19 is a diagram in which illustration of a housing 5 is emitted in FIG. 17.
Figure 20:
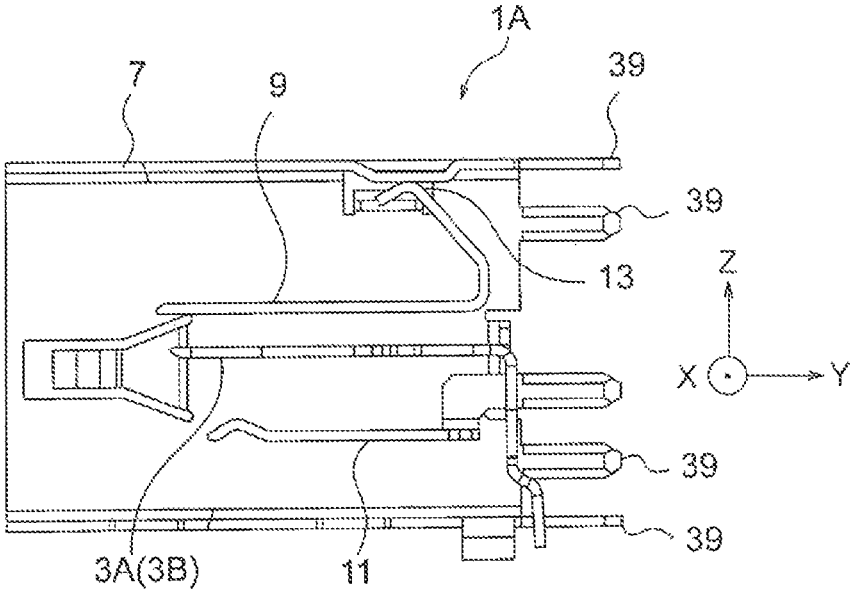
FIG. 20 is a diagram in which illustration of the housing 5 is omitted in FIG. 18.
Figure 21:
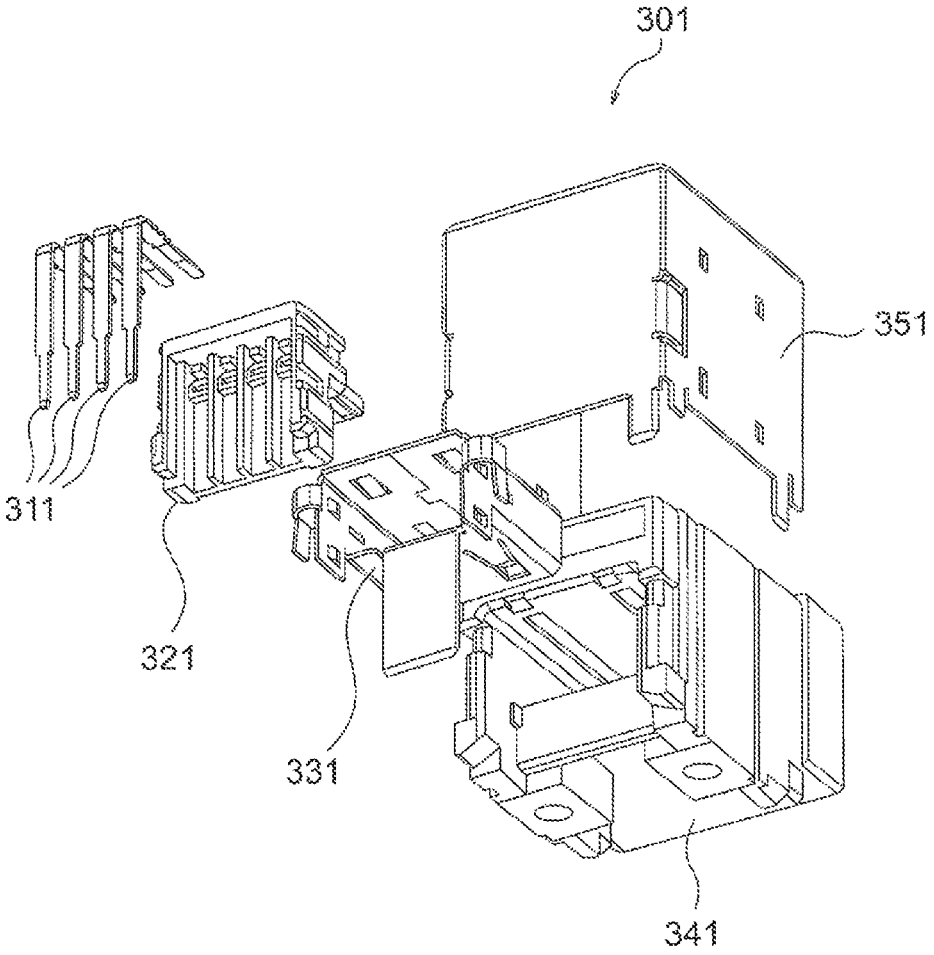
FIG. 21 PRIOR ART
FIG. 21 is an exploded perspective view showing a conventional connector 301.

Further, as shown in FIGS. 15 and 18, an upper ground terminal 9 is configured such that a contact portion 13 is in contact with a top inner surface of the shell 7, not the rear inner surface of the shell 7. However, even in this structure, a non-contact inner surface 47 is provided forward of a contact inner surface 45 in a fore direction (direction B in FIG. 18) in which the shell 7 is mounted on the housing 5, and further, the non-contact inner surface 47 protrudes more than the contact inner surface 45 by a distance L in an up direction (direction F in FIG. 18) in which the contact portion 13 contacts the contact inner surface 45. In other words, the contact inner surface 45 protrudes more than the non-contact inner surface 47 in a down direction (direction E in FIG. 18) opposite to the up direction F.

As shown in FIG. 15, a lower ground terminal 11 has a shape in which an inserting portion 65 is bent laterally by 90 degrees relative to a lower elastic portion 61, but is parallel to the lower elastic portion 61 in the fore-and-aft direction Y in which the connector 1A and the mating connector 95 are fitted to each other.

As shown in FIG. 15, the shell 7 is provided with shell-side ground terminals 39 at its rear surface. Further, as shown in FIG. 18, the contact inner surface 45 with the upper ground terminal 9 is provided at the top surface of the shell 7.

As described above, according to the second exemplary embodiment, the connector 1A includes the signal terminals 3A and 3B as the at least one first terminal having conductivity, the housing 5 having insulating property and holding the signal terminals 3A and 3B, the shell 7 having conductivity and covering the housing 5, and the upper ground terminal 9 as the second terminal having conductivity and the lower ground terminal 11 as the third terminal having conductivity which are held by the housing 5 so as to face each other via the signal terminals 3A and 3B with a space left therebetween, wherein the upper ground terminal 9 has the contact portion 13 being in contact with the contact inner surface 45 of the shell 7.

Accordingly, the second exemplary embodiment exhibits the same effect as the first exemplary embodiment.

While the preferred exemplary embodiments of this invention have been described with reference to the accompanying drawings, this invention is not limited thereto. It is apparent that those skilled in the art can think of various changes and modifications in the category described in the claims and it is understood that those also naturally belong to the technical scope of this invention.

For example, the shell-side ground connecting portion 43 for connecting the shell 7 to the ground terminal 91 of the unit housing 89 is provided to the shell 7 in the first exemplary embodiment, but if the shell 7 can be securely grounded only by the board 81, the shell-side ground connecting portion 43 may be omitted. Although, in the above-mentioned exemplary embodiments, the connector 1 or 1A includes the signal terminals 3A and 3B as the first terminals having conductivity, the present invention is not limited to this, the connector may include only one signal terminal or three or more signal terminals as first terminal(s) having conductivity.

What is claimed is:

1. A connector comprising:

at least one first terminal having conductivity;

a housing having insulating property and holding the at least one first terminal;

a she having conductivity and covering the housing; and a second terminal having conductivity and a third terminal having conductivity that are held by the housing so as to face each other via the at least one first terminal with a space left therebetween, wherein the second terminal comprises a contact portion being in contact with a contact inner surface of the shell.

2. The connector according to claim 1, wherein the shell comprises a shell-side elastic portion provided at the contact inner surface and adapted to be elastically deformed in a direction in which the contact portion applies a pressure.

3. The connector according to claim 1, wherein the connector is a connector adapted to be mounted on a board and the third terminal is a lower ground terminal adapted to be connected to a ground terminal of the board.

4. The connector according to claim 1, wherein the second terminal is an upper ground terminal adapted to be connected to a ground terminal of a mating connector adapted to be fitted to the connector.

5. The connector according to claim 1, wherein the third terminal is a lower ground terminal adapted to be connected to a ground terminal of a mating connector adapted to be fitted to the connector.

6. The connector according to claim 1, wherein the shell comprises a ground connecting portion adapted to be connected to a ground terminal of a unit housing adapted to be disposed outside the shell.

7. The connector according to claim 1, wherein the shell has a box shape with a front surface, being opened as an open surface of surfaces crossing a direction in which a mating connector as a fitting object and the connector are fitted to each other, and wherein the contact portion is in contact with a rear inner surface, facing the open surface, of the surfaces of the shell.

8. The connector according to claim 1, wherein the second terminal comprises a terminal-side elastic portion that presses the contact portion into contact with the contact inner surface of the shell.

9. The connector according to claim 8, wherein the housing comprises a backup portion provided to contact an outer surface, on a side opposite to the contact inner surface, of the shell.

10. The connector according to claim 8, wherein the contact inner surface is a surface parallel to a direction in which the shell is mounted on the housing, wherein the shell comprises a non-contact inner surface provided forward of the contact inner surface in the direction in which the shell is mounted on the housing, and wherein the non-contact inner surface protrudes more than the contact inner surface in a direction in which the contact portion contacts the contact inner surface.

* * * * *